US006070392A

United States Patent [19]

Berman et al.

[11] Patent Number: 6,070,392

[45] Date of Patent: Jun. 6, 2000

[54] HOT POUR PRODUCT SAMPLER AND METHOD OF MAKING USING BULK THIN FILM APPLICATION TECHNIQUES

[75] Inventors: Michael J. Berman, Southampton, Pa.; William Deierlein, Plainsboro, N.J.

[73] Assignee: Retail Communications Corp., New York, N.Y.

[21] Appl. No.: 09/065,219

[22] Filed: Apr. 23, 1998

[51] Int. Cl.[7] ..... B65B 63/08; B65B 9/02

[52] U.S. Cl. ..... 53/440; 53/127

[58] Field of Search ..... 53/440, 127, 450, 53/383

[56] References Cited

U.S. PATENT DOCUMENTS 4,725,495 2/1988 Garbe et al. .
4,752,496 6/1988 Fellows et al. .
4,755,433 7/1988 Patel et al. .
4,876,136 10/1989 Chang et al. .
4,884,680 12/1989 Israel et al. ..... 206/44
4,925,667 5/1990 Fellows et al. .
5,066,486 11/1991 Kamen et al. ..... 424/63
5,072,831 12/1991 Parrotta et al. .
5,192,386 3/1993 Moir et al. .
5,562,112 10/1996 Gunderman et al. .
5,622,263 4/1997 Greenland ..... 206/581
5,690,130 11/1997 Gundermann et al. ..... 132/319
5,806,285 9/1998 Rizzieri ..... 53/453

*Primary Examiner*—John Sipos
*Attorney, Agent, or Firm*—Ryndak & Lyerla

[57] ABSTRACT

A method for producing hot pour product samplers that incorporates the genuine hot pour product through the use of bulk thin film application techniques such as extrusion or spray technology. The method comprises first applying a hot pour product to a base substrate, and then attaching a cover sheet by means of an adhesive or heat-seal die adhesive on either wide-web offset or narrow-web equipment.

33 Claims, 11 Drawing Sheets

HOT POUR PRODUCT SAMPLER AND METHOD OF MAKING USING BULK THIN FILM APPLICATION TECHNIQUES

FIELD OF THE INVENTION

The present invention relates to a hot pour product sampler that incorporates the genuine lipstick or other hot pour product and a method of making the sampler by application of the lipstick or other hot pour product to a substrate such as paper or film through the use of bulk thin film application techniques.

BACKGROUND OF THE INVENTION

Traditionally, hot pour products such as lipsticks have been packaged in containers such as bottles, jars, flasks, boxes, compacts and tubes. Additionally, hot pour products have been molded into various shapes such as a cylindrical shape or a pomade and enclosed in a container which may be of a corresponding different shape than the hot pour product. More recently, hot pour products such as lipsticks and other cosmetics have been placed in sampling devices for use in magazine inserts, postcards, department store catalogs and billing cycles and other sales promotion vehicles, and have been used as store handouts. The sampling devices contain a small quantity of hot pour product or a substance simulating a hot pour product that can be removed and applied to the lips or skin by a consumer.

Hot pour product sampling devices such as for lipsticks are also produced using silk-screen printing such as in U.S. Pat. No. 5,562,112. The silk screen printing method is relatively economically unfeasible and it requires multiple manufacturing steps to produce a finished product.

A method disclosed in U.S. Pat. No. 5,072,831 provides a transfer layer of a colored heavy, waxy oily material, removable by fingertip and spreadable by skin, in forming an advertising sampler. However, this sampler is made from a composition which is intended to only mimic the color of the genuine cosmetic product advertised. The sampler does not contain the actual hot pour product advertised.

One method disclosed in U.S. Pat. No. 4,752,496 provides printing a cosmetic onto a substrate using standard printing techniques. This method requires that non-dry cosmetics, i.e., lipstick, first be modified to a dry micro-particulate form. Col. 3, lines 53–55. Second, a carrier is added to the cosmetic to form a slurry of cosmetic. Col. 4, lines 33–35. Finally, this slurry is applied to a substrate.

Another method disclosed in U.S. Pat. No. 5,192,386 teaches application of cosmetics to a treated substrate using screen printing. This sampler does not utilize bulk thin film application, i.e., non-printing technology. A need exists to produce hot pour product samplers using non-printing technology.

A need exists for inexpensive mass producing hot pour product samplers such as lipstick. A need also exists to provide a hot pour product sampler encompassing the actual hot pour product advertised, not another product that mimics the genuine product. Hot pour products typically have a very defined appearance and feel. A need exists to form a hot pour product sampler without having to form a slurry or solid before application of the product. Finally, a need exists to effectively utilize bulk thin film application techniques to produce an economical hot pour product sampler.

SUMMARY OF THE INVENTION

In accordance with one aspect of the invention, a hot pour product sampler such as a lipstick sampler is formed using wide-web offset or gravure printing machinery with in-line finishing capability. In accordance with this aspect of the invention, the application of the hot pour product to be sampled is applied by bulk thin film techniques. Print stations are used for printing conventional information and not for application of the hot pour product. For example, indicia, visible to a user of the sampler prior to opening it, which may be printed or otherwise, may be provided on the sampler identifying the specific type and brand, including by trademark or otherwise, of the actual hot pour product or lipstick contained in the sampler. Hot pour products are applied using a bulk thin film technique, i.e., nonprinting technology, in the in-line finishing line such as by pulsed, metered on-demand spraying or pulsed, metered on-demand extrusion, or continuous spraying, or continuous extrusion, for example.

In accordance with another aspect of this invention, hot pour products are first liquefied, or at least partially melted, from a wax- or oil-based state, applied to a substrate, and then cooled and set in an appropriate thickness and position. This is different from the system used in the application of conventional cosmetic products, which requires heat or dwell time to drive off volatile solvents such as isopropyl alcohol.

In accordance with yet another aspect of this invention, a hot pour product sampler is formed using narrow-web roll-to-roll machinery, for example, machinery traditionally used to produce labels. Hot pour products are applied using a bulk thin film technique, i.e., nonprinting technology such as by pulsed, metered on demand spraying or extrusion, or continuous extrusion, or continuous spraying, for example as the web substrates are being conveyed. This method enables economical mass production of hot pour product samplers of various configurations, including delivery of a sampler on a carrier liner for inexpensive, fast dispensing and affixing.

In accordance with another aspect of the present invention, a hot pour product sampler can be mass produced utilizing the genuine hot pour product and not an ersatz hot pour product that imitates the color of the genuine hot pour product. Consumers most likely would prefer to view and sample the actual hot pour product to enable them to accurately match color, look and feel. Any attempt to apply the hot pour product to a substrate generally requires that the hot pour product not bleed or leak or stain in the substrate, nor can the hot pour product itself be altered in its own final color, feel or appearance or separate into different fractions.

In the present invention, at the time of application of the hot pour product, the product is in a liquid or semi-liquid state. Re-melting of the product after application to a substrate to obtain the proper consistency is not required. Application of the hot pour product occurs as the web substrate is being conveyed.

In accordance with yet another aspect of the invention, pulsed, metered spraying or pulsed, metered extrusion, or continuous spraying, or continuous extrusion application is utilized for efficient bulk thin film application of the hot pour product. Pulsing or intermittent application provides hot pour product application in discrete spaced apart areas on a substrate web. By using less hot pour product during the process, the overall cost of actual hot pour product is reduced. Continuous spraying or continuous extrusion provides an even unbroken laydown of the hot pour products that is easy to produce, and easy to monitor for quality control purposes.

In accordance with yet another aspect of the invention, continuous spraying or continuous extrusion application is utilized for a uniform bulk thin film application of the hot pour product. In the context of certain design configurations, continuous spraying or continuous extrusion allows faster press speeds, less down time for press stops, and better quality control. These advantages may outweigh the cost of spraying or extruding excess hot pour product which is not present in the final product, and the overall unit cost of hot pour product samplers may be less using continuous spraying or continuous extrusion.

In accordance with yet another aspect of the invention, continuous extrusion or spraying of the hot pour product allows construction of a relatively inexpensive system. Both the spray and extrusion systems can, with simple adjustments, provide varying widths and thicknesses of laydown and create a solid, unbroken line of applied materials that are easy to monitor in quality control.

By "genuine hot pour product" it is meant that the hot pour product that is applied as a thin film which is incorporated into the sampler includes the genuine, actual hot pour product, and is not an imitation or ersatz hot pour product composition that attempts to mimic the color of the genuine hot pour product composition as in U.S. Pat. No. 5,072,831.

DETAILED DESCRIPTION OF THE INVENTION

Figure 1:
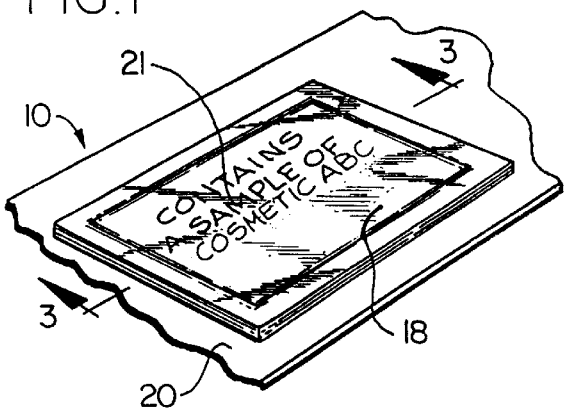
FIG. 1 is a perspective view of a sampler containing a hot pour product covered by a cover substrate.
Figure 2:
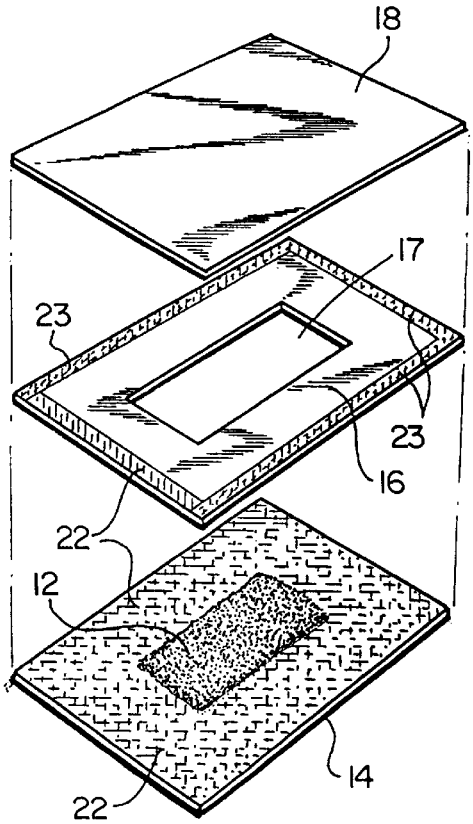
FIG. 2 is a perspective view of the layers that form the sampler of FIG. 1.
Figure 3:
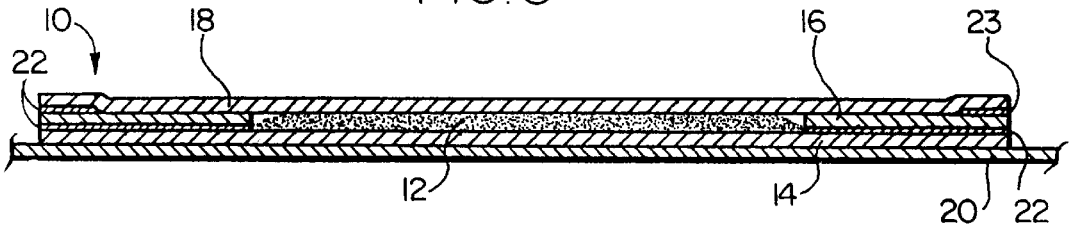
FIG. 3 is a cross-sectional view of the sampler of FIG. 1 taken along line 3—3.

Referring to the figures generally, and specifically to FIGS. 1, 2 and 3, there is illustrated a hot pour product sampler 10. Hot pour product sampler 10 can be comprised of several layers, including base 14, intermediate layer 16, cover 18 and liner layer 20. Hot pour product sampler 10 is a relatively flat sampler for use in bind-ins, catalogs, statement enclosures, remittance envelopes and postcards. A layer of hot pour product 12 which can be tested and compared by a consumer is present on a base 14. Typically, an intermediate layer 16 with die-cut area 17 is affixed to base 14 by means of adhesive 22 for example. Cover 18, which may contain printing on one or both sides can be affixed to the sampler with heat seal adhesive 23. Hot pour product sampler 10 can be affixed to a liner layer 20 or other pressure sensitive adhesive backing or similarly functioning layer. Hot pour product sampler 10 includes printed indicia 21, preferably identifying the actual hot pour product contained therein. Additionally, heat seal adhesive 23 may not cover the entire perimeter of intermediate layer 16. In such circumstances, lip 19' may be formed to enable easy opening of sampler 10. To further facilitate opening sampler 10, perforations 19 may be formed on cover 18.

Figure 4:
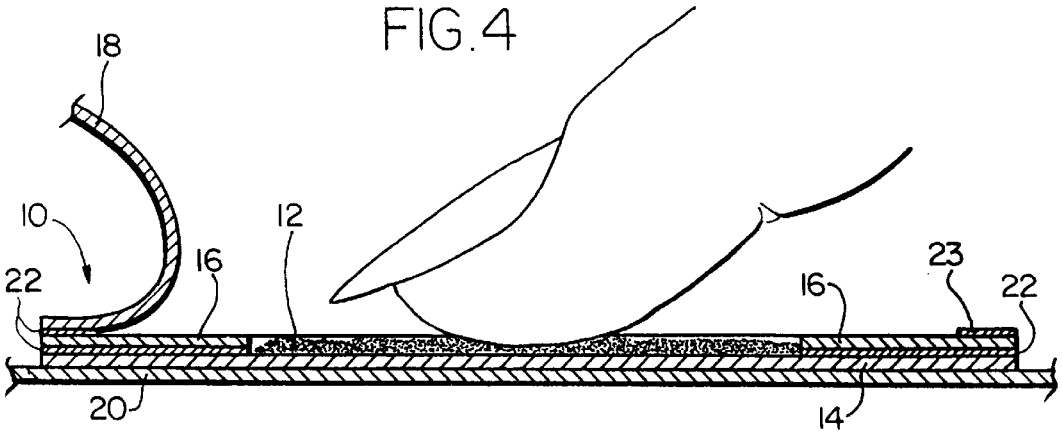
FIG. 4 is a cross-sectional view of the sampler of FIG. 1 taken along line 3—3 showing the cover substrate pulled back and the hot pour product being removed from the sampler.

Referring to FIG. 4, there is illustrated a hot pour product sampler 10 which has cover 18 peeled back. Heat seal adhesive 23 prevents cover 18 from separating from intermediate layer 16 and base 14. When cover 18 is peeled back from hot pour product sampler 10, a consumer is able to remove hot pour product 12 from base 14 by applying pressure. Hot pour product 12 can then be applied to the skin and compared for color, texture and other desired characteristics by the consumer.

For purposes of the present invention, the term "lipstick" shall mean an oil- or wax-based preparation for coloring the lips. For purposes of the present invention, "hot pour cosmetics" refer to those preparations applied to parts of the human body to enhance appearance or other aesthetic (such as odor) that are meltable or substantially in a liquid phase at a moderately elevated temperature such as about 150–200° F., for example, and generally substantially solid at room temperature. The oils or waxes may be natural and/or synthetic. Natural waxes may be animal, vegetable or mineral derived. For the present invention, "hot pour products" shall mean lipstick or hot pour cosmetic. Hot pour products include but are not limited to lipsticks, pan makeup, creme-to-powder formulations, creme blush, eyeshadows and noncolored products such as solid perfume. The above definition of "hot pour products" specifically excludes cosmetics that are not both substantially a solid at room temperature and meltable to form substantially a liquid for application to a sampler.

For purposes of the present invention, the term "spraying" refers to pushing, propelling, or thrusting materials through an orifice by means of independent pressure, such as air pressure, or an airless system, such as using harmonic vibration or vacuum, to propel the hot pour product onto the substrate at a distance, usually from about 0.025" to about 4.00" from the end of the orifice. For purposes of the present invention, the term "extrusion" refers to ejecting the material to be applied through an orifice usually of specific shape and area, which orifice is directly, or substantially directly, in contact with the paper or substrate to which the hot pour product is to be applied. For purposes of this invention, "kiss cut die cutting" refers to die cutting by any suitable means through at least one but not all of the layers in a construction.

The genuine bulk hot pour product may be supplied in liquid or solid or any other form or phase which is capable of being transformed into a composition suitable for bulk thin film application techniques, such as spraying or extrusion. Hot pour products contain anhydrous materials in thin liquid to semi-solid form, such as micro-crystalline waxes. These micro-crystalline waxes, typically hydrocarbon or ester waxes, are used to control various features of the finished sampler product. These waxes affect the final consistency of the hot pour product, the parameters of the application process, and the aesthetics and pigmented permanency of final product. The hot pour product may be applied to a substrate without any additives. If necessary or desired, certain additives may be used. Each particular genuine bulk hot pour product has a different optimal mixture of natural and/or synthetic waxes (such as, for example, paraffin, carnauba, lanolin), oils (castor, mineral, glycols, for example), pigments (metal oxides, organics, lakes, pearlescent pigments, for example), and other additives. The choice of optimal overall composition is also dependent on the method of application, i.e., whether the hot pour product is applied by spraying, extrusion or other means, the color shift of the hot pour product, the removability of the hot pour product, the flexibility of the hot pour product and other factors. It is possible that different compositions of the genuine hot pour product and additives will produce useable hot pour product samplers. The viscosity of the hot pour product should be suitable for the bulk thin film application technique being utilized, i.e., spraying or extrusion. The viscosity is preferably between 25 to 600 cps for spraying, and between about 300 to 1800 cps for extrusion. Additionally, the optimal composition should achieve a final hot pour product sample that accurately matches what the actual hot pour product looks like on the skin.

The present invention does not utilize any solvent or carrier solution for the hot pour product prior to or during application. The hot pour product is melted or substantially melted prior to application to the substrate. Hot pour products typically have melting points between 170° F. and 190° F., depending on the waxes and solids present. Lipsticks may have generally higher or lower melting points such as between 120° F. and 205° F. The hot pour product or lipstick is melted by any suitable means such as in a heating tank prior to application to a substrate.

Although the hot pour product may be applied onto the sampler with no additives, several ingredients may be helpful. Oils may be useful in the present invention to make a hot pour product more flexible, softer or less dense. Oils promote an even laydown of the hot pour product. The choice of oils is affected by a variety of factors including the density of the hot pour product and the desired laydown of the hot pour product. The oils which may be added to the hot pour product in accordance with the present invention include castor oil, mineral oil and polyethylene glycol, for example.

Pigments may be added to the hot pour product in accordance with the present invention to adjust the color of the hot pour product. Additionally, pigments may make the hot pour product appear to be thicker or more luscious. The pigments which may be added to the genuine hot pour product include metal oxides, organic pigments and pearlescent pigments.

Waxes may be added to the hot pour product for various purposes. For example, paraffin, ozokerite or beeswax may be mixed in to add hardness, stiffness or shine to a hot pour product. Other waxes, such as carnauba or candelilla may be added to increase the melt temperature of the mixture, add shine to the hot pour product or to make the final product more brittle. Alternatively, lanolin or petrolatum may be included to promote flexibility in the hot pour product, soften the hot pour product or aid in adhesion of the hot pour product to the base substrate. Microwaxes may also be used to improve adhesion or flexibility.

Optionally, emollients such as volatile silicone, isopropyl myristate, myristyl myristate and glycerin, in liquid or microencapsulated state, for example, may be added to the hot pour product. These emollients may make the hot pour product feel smoother when applied to the skin.

For all of the embodiments of the present invention, the base substrate should be suitable to contain a hot pour product without bleeding or staining through while allowing the hot pour product to be readily removable. The base substrate may be composed of coated or uncoated paper or film such as polypropylene, polyethylene or mylar™, or a combination of these. Additionally, a film carrier or liner layer, such as forty-pound paper or 2-mil polypropylene, coated with a release liner, may be present as part of the base substrate. The thickness of the base substrate should be between 1 mil and 12 mil. In some embodiments of the present invention, the base substrate consists of one or more layers of paper with a polypropylene layer. These layers can be assembled to form one web of base substrate in a separate area using, for example, Hot Melt 2107 H. B. Fuller permanent adhesive. For example, equipment 60 shown in FIG. 5 requires a base substrate of at least two layers. For this embodiment, 1 layer of 40-pound coated 2-sided paper, 1 layer of 40-pound coated 1-sided paper, and one layer of 2 mil polypropylene may be used and assembled with adhesive. The paper carrier layer may be treated with silicone or similarly functioning substance to enable easy removal during the process.

The cover substrate, and if desired, intermediate substrate, may be comprised of film or any other suitable material for enclosing the hot pour product. Die-cut areas may be registered to correspond roughly with the areas of hot pour product. However, the die-cut areas may be slightly smaller than the area of hot pour product to create a bleed area beyond the open area. Additionally, the die-cut areas may be slightly larger than the area of the hot pour product. Moreover, the cover substrate may be folded in half to function as both a cover and an intermediate layer. Substrates may be adhered to each other by use of a permanent adhesive, such as, for example, Flexacryl LC-14, or by heat sealing. Additionally, to allow a consumer to easily pull back the cover substrate, a peelable adhesive, such as, for example, Craig Bond 3991PLV (Diluant Craig 3991PID), or a heat seal adhesive may be used to seal all four sides around the area of the hot pour product.

The present invention is a method of applying hot pour products to a substrate such as film or paper through the use of a bulk thin film technique, such as non-printing technology which forms a sheet of hot pour product samplers. The present invention may be operated on at least two types of equipment: narrow-web roll-to-roll machinery or a wide-web offset press. Additionally, the present invention may utilize any other suitable method for mass producing hot pour product samplers. Separate stages within the narrow-web or web offset equipment are often used for applying the hot pour product, cooling the applied product, applying conventional or heat seal adhesive, and applying the cover substrates. Narrow-web roll-to-roll machinery may be acquired from any suitable source including, for example, Webtron of Ft. Lauderdale, Fla., or Mark Andy of Chesterfield, Mo. Material can be fed through the narrow-web equipment at speeds of between about 30 and 300 feet per minute.

Figure 5:
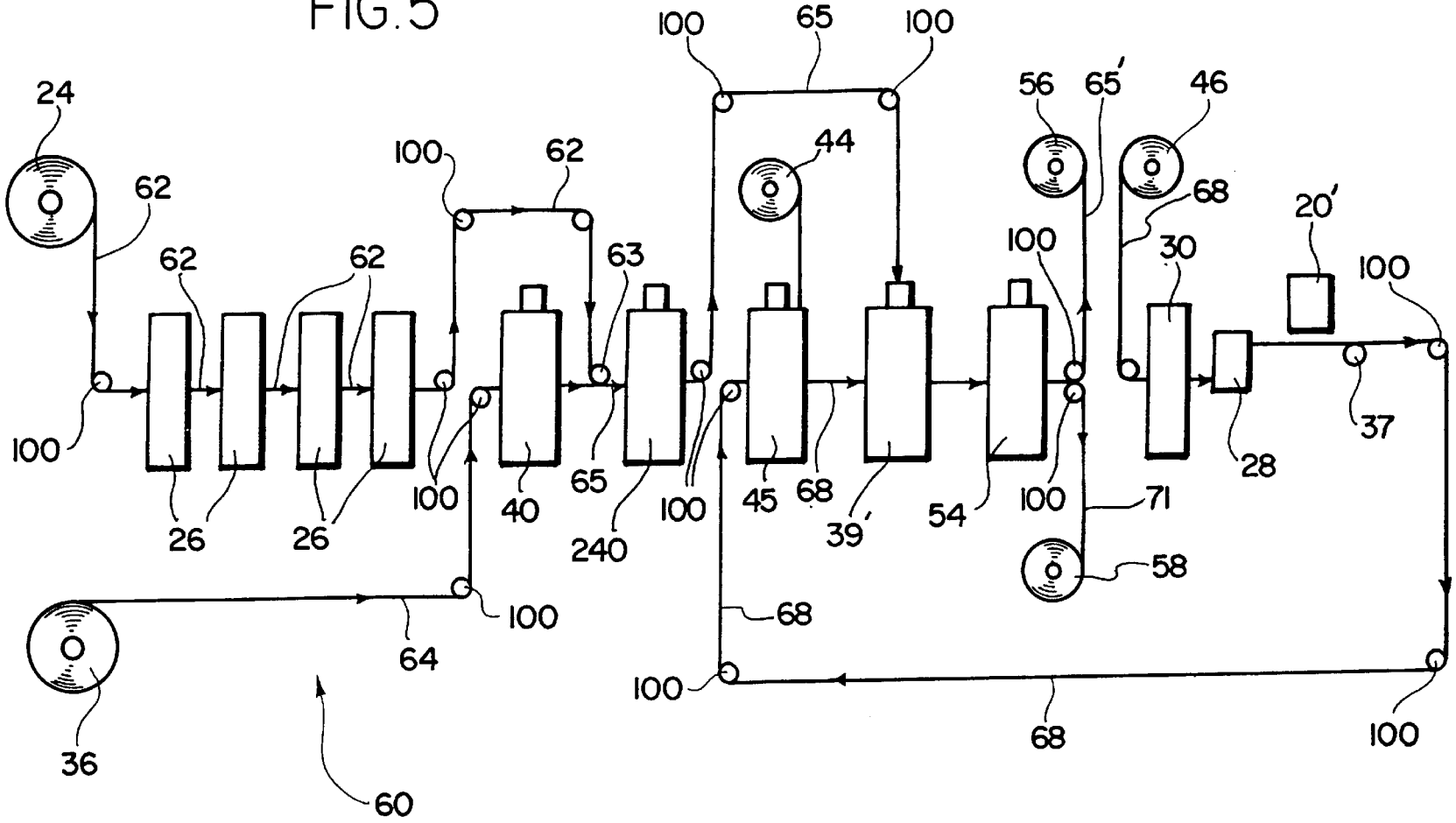
FIG. 5 is a diagrammatic view showing the steps of producing a hot pour product sampler using a narrow web roll-to-roll three web unwind machine.
Figure 6A:
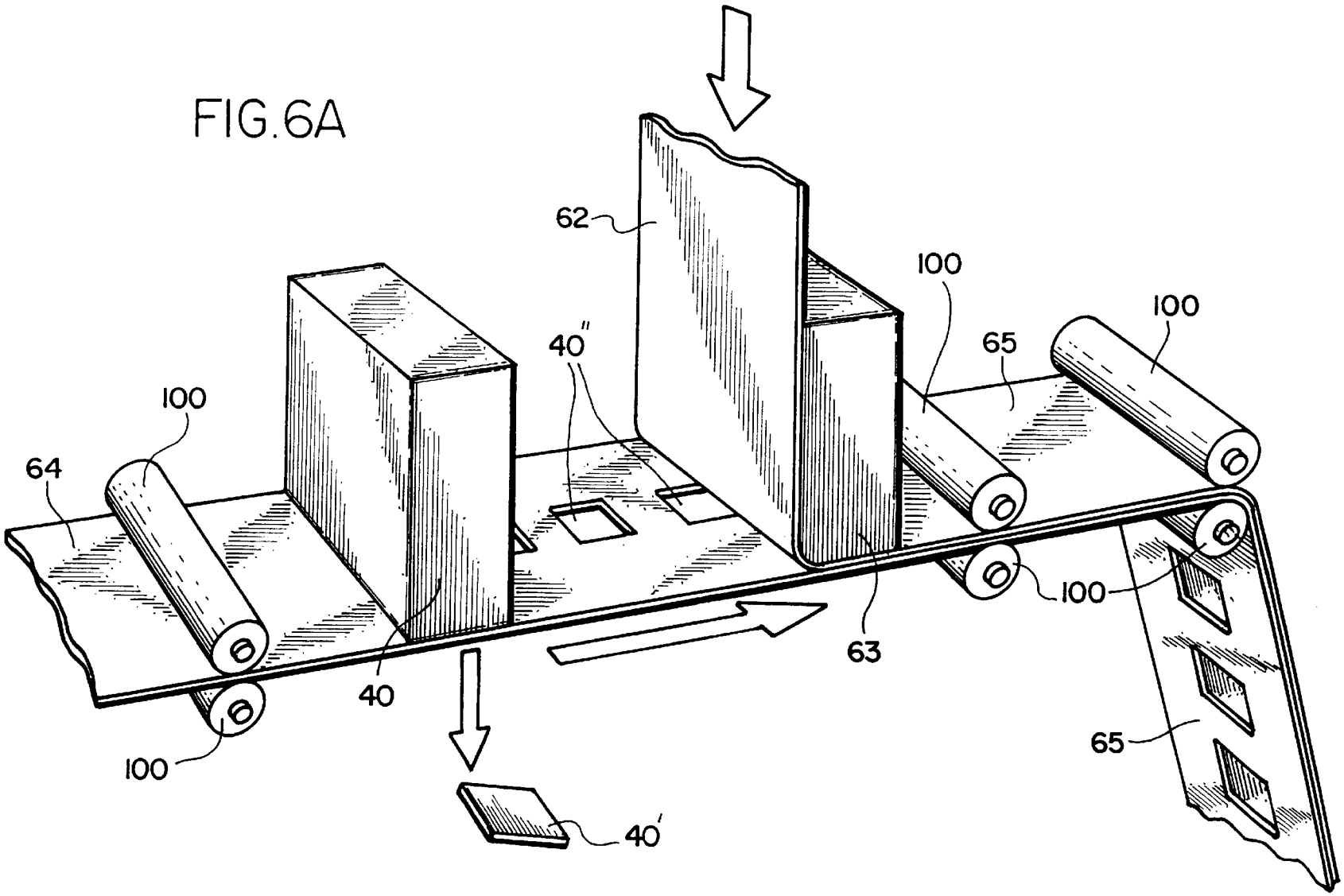
FIG. 6A is an enlarged diagrammatic view of the machine in FIG. 5 showing the steps relating to combining the top and middle layers of the sampler.
Figure 6B:
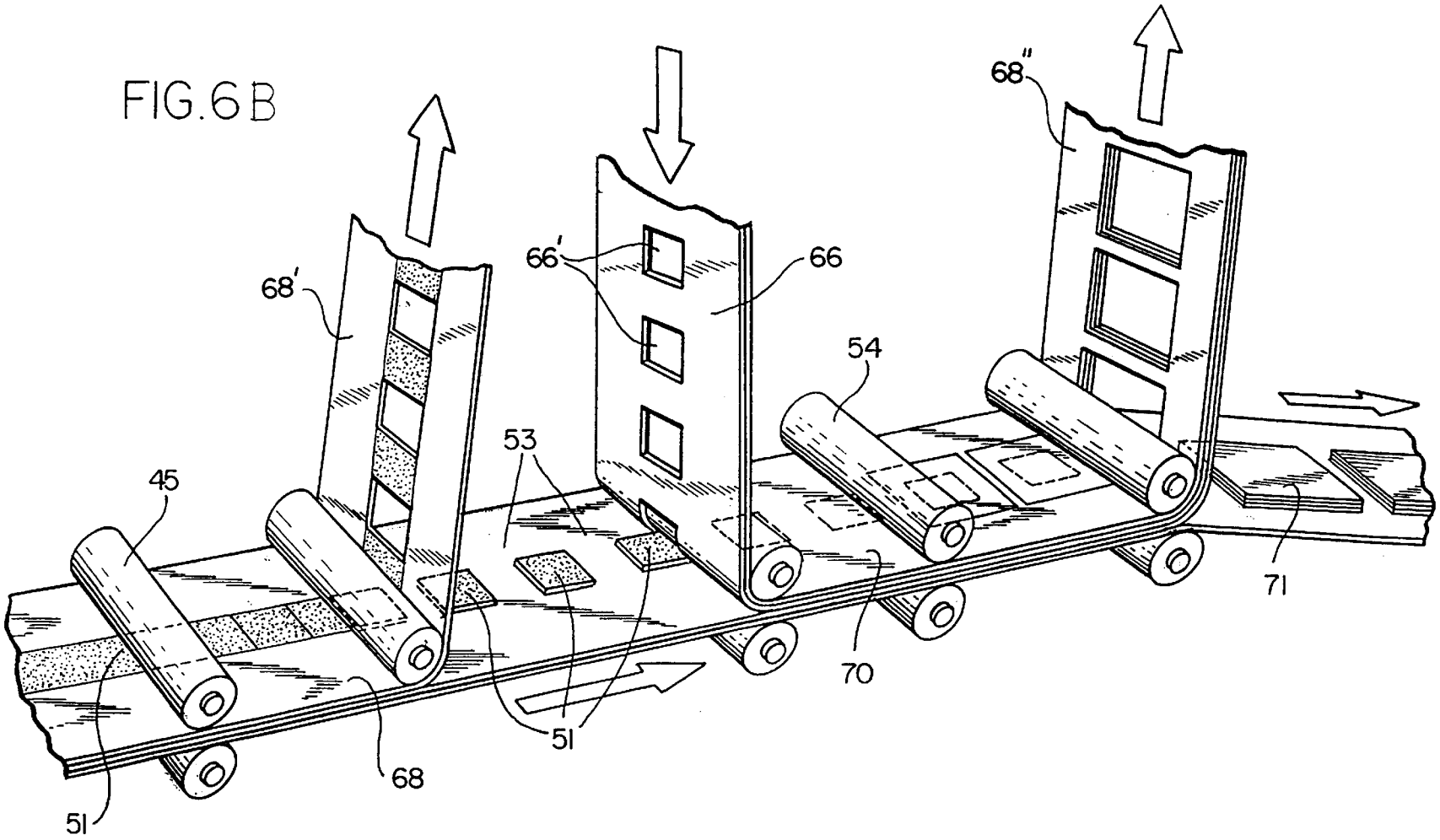
FIG. 6B is an enlarged diagrammatic view of the machine in FIG. 5 showing the final steps in producing a cosmetic sampler.

Referring to FIGS. 5, 6A and 6B, equipment 60, the preferred embodiment of the narrow-web machinery is shown. Equipment 60 consists of three separate webs of substrates web 24, web 36 and web 46. These three webs at some point merge to form product rewind 58. All three webs are run simultaneously and at the same speed using rollers 100 to guide the webs. Web 24 runs a cover substrate 62 through print stations 26. Print station 26 prints advertising or other desired material on the cover of the sampler by conventional means, such as by use of flexographic printing plates. Additional print stations may be utilized for printing additional colors or details. Substrate 62 may also be coated with an ultraviolet curable varnish and cured with ultraviolet lamps or similarly treated at one of the print stations 26 to provide for a smooth-protected finish. Additional print stations and use of turnbar rollers or other suitable device may also optionally be employed to reverse cover substrate 62 onto its back side to facilitate printing on both sides in multiple colors.

As illustrated in FIG. 5, the second web, web 36, feeds middle substrate 64 at the same speed as web 24 feeds cover substrate 62. Middle substrate 64 is die cut by any suitable means to allow for the removal of an area of substrate 64 suitable for viewing and accessing a genuine hot pour product in the finished sampler. As illustrated in FIG. 6A, die cutting may be achieved through die station 40. Such die-cut areas 40' are removed from substrate 64 by vacuum pump or any other suitable means leaving openings 40". Substrate 64 then passes to sealer 63, where a glue or adhesive is applied (if not already present) and substrate 62 is married to substrate 64 to form combined substrate 65. The glue or adhesive may be one or more of the following: a conventional permanent glue, a peelable glue, a heat sealable adhesive or a peelable heat sealable adhesive. The glue or adhesive is applied to at least a portion of one edge of one side of substrate 64 by any suitable method. Typically, for example, three edges of one side of substrate 64 are covered with peelable hot seal adhesive to allow a consumer to peel back this cover from the final hot pour product sampler, while one side of substrate 64 is covered with permanent hot seal adhesive. For the preferred embodiment, peelable heat sealable adhesive is applied on all four edges of substrate 64. Combined substrate 65 may then be coated with an ultraviolet curable varnish and cured with ultraviolet lamps or similarly treated at deck 240 to provide for a smooth protected finish.

As illustrated in FIG. 6A, substrate 64 is married to substrate 62 sealer 63 by any suitable means to form substrate 65. Such means include but are not limited to a heat sealing die or lamination as is known in the art.

The third web, web 46 feeds base substrate 68 into equipment 60 at the same speed that web 24 and web 36 feed cover substrate 62 and middle substrate 64, respectively. In the preferred embodiment, base substrate 68 consists of three layers: two layers of paper and one layer of silicone treated polypropylene. Print station 30 prints advertising or other desired material on the bottom of the sampler by conventional means, such as by use of flexographic printing plates. If necessary, turnbar 28 or rollers may be used to reverse substrate 68 over to allow laydown of the hot pour product on the appropriate side. At station 20', the genuine hot pour product is applied to substrate 68 using bulk thin film techniques, such as continuous spraying, pulsed, metered spraying, or pulsed, metered extrusion or continuous extrusion. Details of the spraying and extrusion systems are provided below. However, it should be noted that the hot pour product is applied to substrate 68 while in a liquid or semi-liquid state. The area intended to be covered with the hot pour product is without substantial breaks or interruptions. Multiple types or colors of the genuine hot pour product may be applied side by side or in any other configuration on base substrate 68 using bulk thin film techniques, such as by multiple parallel sprayers or extruders, to create a hot pour product sampler containing several different genuine hot pour products.

The hot pour product, after being applied to the base substrate, should be suitably cooled and set to form a solid lipstick or a hot pour product layer 51 of an appropriate thickness and position. The hot pour product may be cooled by chill rollers 37 or by any suitable means to adequately set and cool the hot pour product. If the product is not adequately cooled and set at a sufficiently quick rate, the solid hot pour product will be uneven or streaky. After cooling, the hot pour product will be a solid or in substantially solid form. In addition, it may be desirable to run base substrate 68 with the hot pour product facing the ground or in other configurations to avoid contact with rollers. Thereafter, base substrate 68 is kiss cut die cut through more or less one layer by a precise die cavity 45 or any other suitable means. Base substrate 68 is rotary kiss cut die cut to a precision depth. The die is specifically designed to cut to such precise depth. Additionally, changing base rollers may fine tune the cutting depth of the die, if necessary, to ensure that only one layer is cut. The area 222 around the die cut on this one layer of base substrate 68, consisting of polypropylene or other suitable substance with the quantity of substantially solid hot pour product 51 laid over it, is removed from base substrate 68 and wound in a waste rewind 44.

As illustrated in FIG. 6B, through use of the appropriate roller tensions and speeds, and an extremely precise die cut, the waste rewind on bottom substrate 68 will contain only a portion of one layer from the base substrate with the associated hot pour product which was applied over this area. Removal of the portion of the polypropylene/film layer reveals adhesive 53 on the substrate 68 where the layer was removed. The balance of bottom substrate 68 comprises a plurality of areas containing a third polypropylene layer and hot pour product 51. These hot pour product areas are surrounded by adhesive 53. At this point in equipment 60, bottom substrate 68 is merged with combined substrate 65 to form resulting substrate 70 such that the exposed permanent adhesive 53 on substrate 68 binds the combined substrate 65 to bottom substrate 68. The die-cut openings 40" in combined substrate 65 should be substantially aligned with the areas of hot pour product 51 on base substrate 68. Using any suitable method such as die cutting at station 39' (shown in FIG. 5), a channel may be formed substantially around the area containing the hot pour product. This channel allows a consumer to open the sampler without completely removing the cover layer. Moreover, this channel maintains the general shape of the hot pour product so that if the hot pour product melts during shipping or otherwise, it solidifies in substantially the same formation. Next, die-cut machine 54 is used to kiss cut die cut resulting substrate 70 through substantially all layers except the liner layer of base substrate 68. This forms individual hot pour product samples 71 from resulting substrate 70. Individual hot pour product sample 71 may be any shape or size to enable a consumer to view and/or sample hot pour products, such as, for example, a two-inch by two-inch square. The carrier liner or pressure sensitive backing may or may not be included. Waste rewind 56 removes the areas 65' around die-cut regions of hot pour product samples 71, leaving a web of product.

Figure 7:
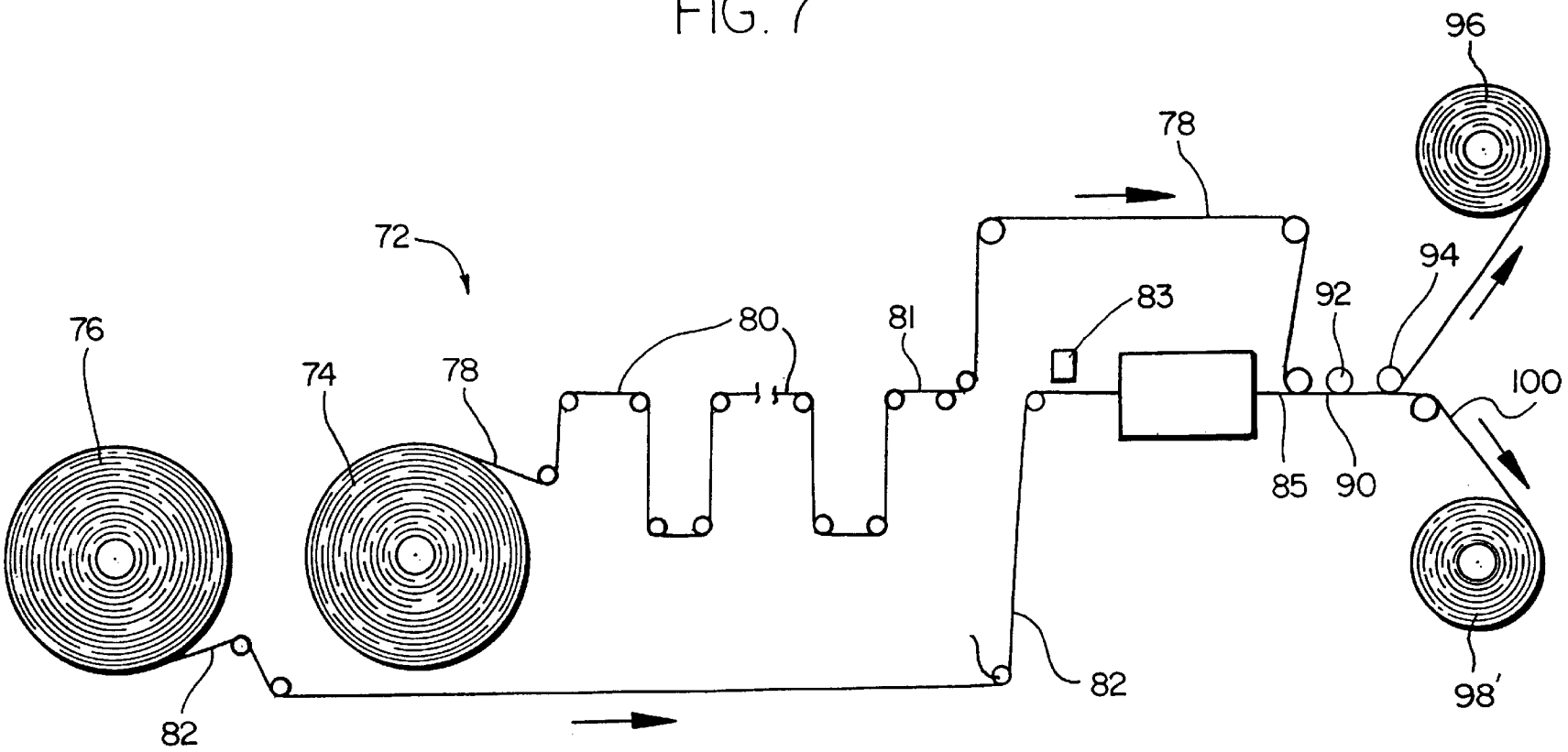
FIG. 7 is a diagrammatic view showing the steps of producing a hot pour product sampler using a narrow-web roll-to-roll, two web unwind machine.

Referring to FIG. 7, an alternative two web narrow-web equipment 72 is shown. Equipment 72 consists of two webs, web 74 and web 76. Web 74 supplies substrate 78 which makes up the cover sheet of the final hot pour product sampler 101. Substrate 78 is printed at printing stations 80 by any suitable printing means, as more fully described above. Additional print stations may be utilized to print more colors, designs or details as desired. Substrate 78 may be coated with an ultra-violet curable varnish and cured with ultra-violet lamps or similarly finished or protected if desired at print station 81. Additional print stations and a turnbar may also optionally be employed to reverse cover substrate 78 onto its back side to facilitate printing on both sides in multiple colors.

Web 76 feeds substrate 82 at the same speed as web 74. Discrete spaced-apart areas of genuine hot pour products are applied using bulk thin film techniques, such as by pulsed, metered extrusion or by pulsed, metered spraying onto substrate 82 at station 83. Between areas of the applied hot pour products, areas of substantially clean substrate 82 should be present. The hot pour products on substrate 82 are then chilled by chill rollers 88 or any other suitable means until appropriately cooled and set. Glue or adhesive such as permanent glue, removable glue, heat sealable adhesive or peelable heat seal adhesive is next applied at die station 85 to the substantially clean areas between areas of applied hot pour product. Substrate 82 is combined at this point with substrate 78 to form combined substrate 90. The combined substrate 90 is then perforation die cut at station 92 to enable a consumer to open the sampler and view the hot pour product. Finally, combined substrate 90 is kiss cut die cut at station 94. This die cutting may go through some or all of the layers, including the carrier layer, producing a finished product. The waste rewind 96 separates and removes unwanted portions from substrate 90, leaving product rewind 98 as the finished product. Alternatively if individual samplers are to be provided, the product may be placed on a belt or stacker instead of a roller.

Figure 8:
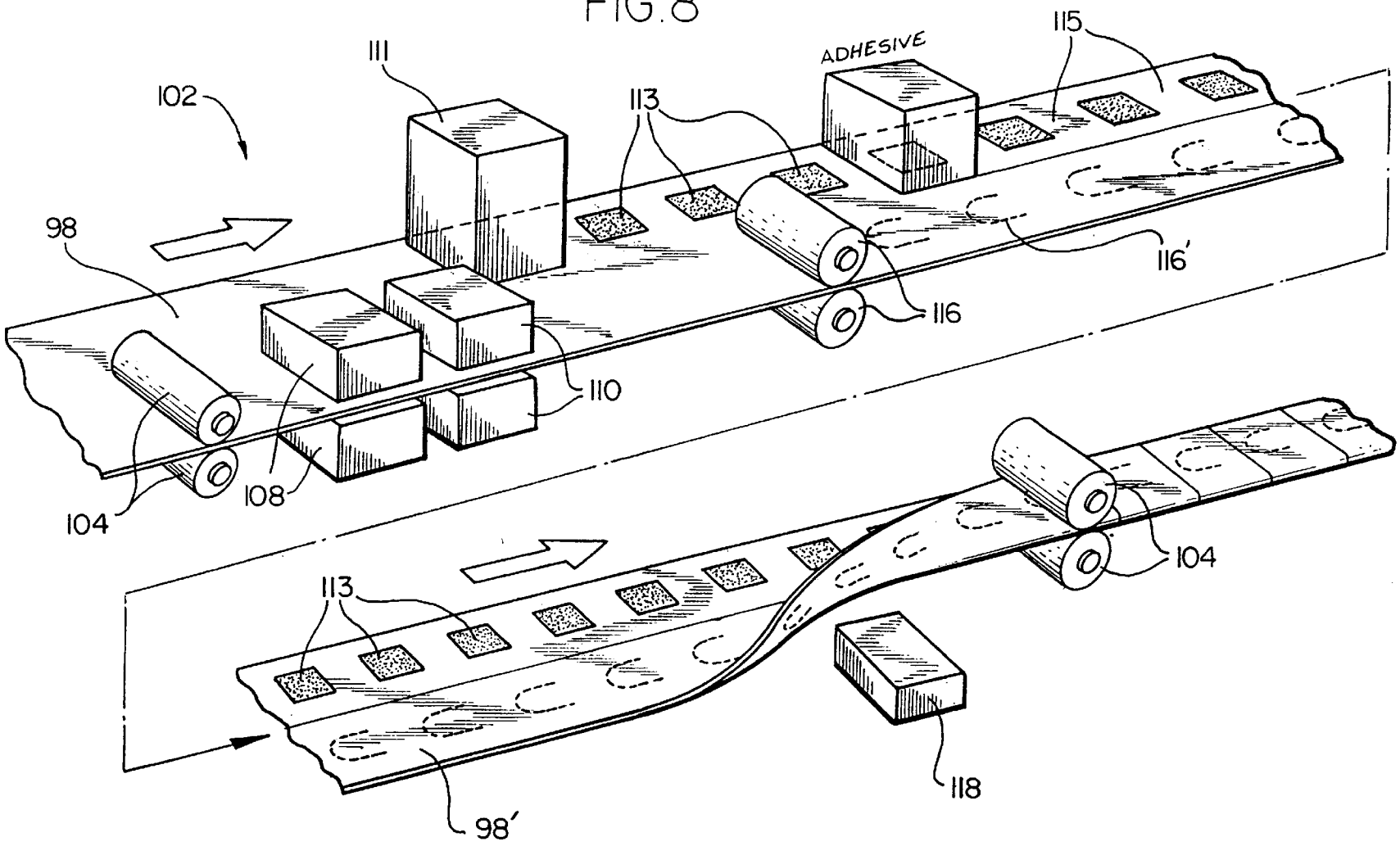
FIG. 8 is a diagrammatic view showing the steps of producing a hot pour product sampler using a wide-web offset press.

Referring to FIG. 8 there is illustrated a method of producing a hot pour product sampler using a wide-web offset press with in-line finishing capabilities. Web offset equipment 102 can be obtained from any suitable source including Hantscho of Rockford, Ill. In-line finishing equipment can be obtained from any suitable source including Scheffer of Merrillville, Ind. Alternatively, the web press stage may be operated completely separate from the in-line finishing stage including being operated at separate facilities. On equipment that can perform both tasks, material can be run through web offset equipment incorporating the present invention at speeds of between about 300 and 1500 feet per minute in direction 102'. Equipment 102 contains web rollers 104 that feed substrate 98' into printing stations 108. Printing stations 108 print material on both sides of substrate 98' by any standard printing means. Angle or tension bars may be used to flip over substrate 98' to allow for printing with specific colors on either side. Multiple print stations may be employed to print on both sides of substrate 98' at substantially the same time, and in multiple colors and configurations. Substrate 98' is fed into oven 110 to dry the printing.

Next, areas of genuine hot pour product are applied to the substrate 98' at station 111 using bulk thin film techniques, such as by pulsed, metered extrusion or pulsed, metered spraying, or continuous extrusion. For continuous extrusion, a method similar to that disclosed for the narrow-web equipment is used, with precision die cutting and rollers used to peel away excess hot pour product. In the wide-web offset equipment, multiple applicators of the same or different types of hot pour products may be situated either in parallel, using pulsed, metered spraying, or in tandem, using pulsed, metered extrusion or continuous extrusion. Proper ventilation and handling are necessary to ensure that mists of hot pour product which do not immediately settle on substrate 98' , do not contaminate the equipment or unintended areas of the web. The areas of hot pour product 113 are cooled and set by any suitable means including for example, chill roller 210. A tower or other suitable device may be utilized to allow the hot pour product more time to chill. Next, the area 116' to be folded over on substrate 98' is perforation die cut at station 116. An area of permanent adhesive or heat seal 115 is applied to be around the dry areas of hot pour product 113 on substrate 98'. If the permanent adhesive 115 comes in contact with the dry hot pour product 113, that contacted area of adhesive 115 may diminish in its adhesive ability. At station 118, substrate 98' is plow folded in half so that the die cut areas align substantially with the areas of hot pour product. The panels of substrate 98' are laminated together or attached by any suitable method.

Figure 9:
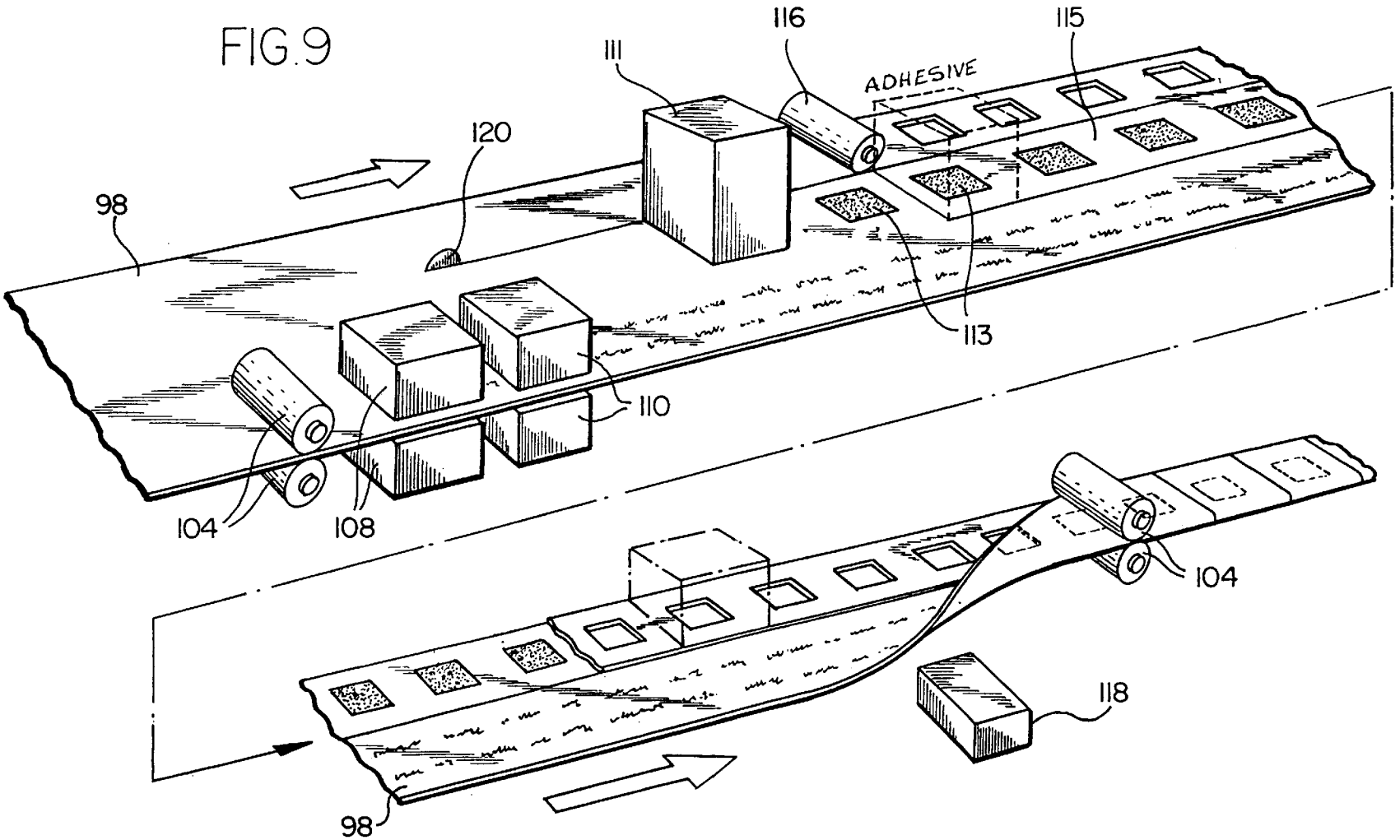
FIG. 9 is a diagrammatic view showing the steps of producing a hot pour product sampler using a wide-web offset press and a slitter.

Referring to FIG. 9, there is illustrated an alternative embodiment of producing a web of hot pour product samplers using wide-web offset equipment 103 operating in direction 200. Substrate 98' can be slit into two or more streams by any suitable method including, for example, blade 120, before applying hot pour product. The genuine hot pour product is then applied to the designated stream of substrate 98' using bulk thin film techniques, such as by pulsed, metered spraying or pulsed, metered extrusion or continuous extrusion. Adhesive (either conventional or heat seal) is applied to at least one of the streams of substrate 98'. Another designated stream of substrate 98' is either die cut or used as a cover substrate. The hot pour product-carrying stream of substrate 98' is plow folded. The multiple streams are all brought together and laminated. Another possible embodiment of the wide-web offset equipment is to use two separate roll stands, one for the base substrate which will contain genuine hot pour products and adhesive, and the second for the cover and intermediate substrate with die-cut areas.

One example of a composition of the hot pour product which was continuously extruded onto a base substrate in the 3-web narrow-web construction at 125° F. and 100 feet per minute is as follows (all percentages are by weight):

Lipstick 93%

Castor Oil 2%

Petrolatum 5%

The unmelted hot pour product can be stored in any suitable container. For extrusion or spraying, the hot pour product is usually fully melted in a sealed, heated feed tank. Upon completion of liquidification, the feed tank is pressurized, such as with compressed air, to a pressure of between about 2 psi and 100 psi. Optionally, an inside shell or other suitable device may be inserted into the feed tank. The inside shell or other suitable device can be removed and disposed of and separately cleaned. This is more convenient and inexpensive than cleaning the entire container with every change in hot pour product. Preferably, an agitation system will be present in the container to maintain a constant composition in the lipstick or hot pour product. The agitation system may, for example, incorporate moving blades or other similarly functioning devices. The agitation system should operate at a sufficient speed to ensure that the hot pour product remains in a suspended state suitable for extrusion or spraying as appropriate. Since the liquid or semi-liquid hot pour product in the heated containers is used for production within a relatively short period of time, only minimal oxidation of the hot pour product will occur. As the hot pour product is applied to the substrate, the amount of hot pour product remaining in the container decreases. As the hot pour product is depleted, air replaces it in the container. Accordingly, the oxidation rate may increase with increased oxygen present. If oxidation becomes problematic, replacement of the air with a nitrogen blank is effective.

For extrusion only, a slot nozzle head system, which may include a shim, delivers the hot pour product to the base substrate, and may be used in the present invention. By minimizing back pressure, this shim aids in completely closing the shut-off valve of the extruder slot nozzle. Such a system will minimize "tailing," which refers to a trail of undefined shape and thickness on the ends of the area of hot pour product sample applied to the base substrate through extrusion. Not completely closing the head of the extruder can result in tailing. For continuous extrusion, positive displacement gear pumps, such as those manufactured by Zenith, are used, creating heavy back pressure, which is controlled by shims.

The hot pour product should be applied to the base substrate by pulsed, metered spraying, continuous spraying or pulsed, metered extrusion or continuous extrusion. For pulsed, metered spraying and pulsed, metered extrusion, the process can be started and stopped in specified time or quantity increments either by use of a control mechanism within the extrusion or spraying apparatus, such as the Model 1250 AutoJet Controller/Driver from Spray Systems Co. of Wheaton, Ill., or by use of a human operator. This results in forming a plurality of areas covered with hot pour products, each with a definite beginning and end and being substantially continuous within such beginning and end. For purposes of the present invention, this intermittent extrusion or spraying is known as "pulsed." Pulsed extrusion can be accomplished by any apparatus sufficient to extrude hot pour products at a suitable rate, including for example the WN-830 from Nordson of Duluth, Ga. Spraying can be accomplished by any apparatus sufficient to spray hot pour products at a suitable rate, including for example the AutoJet, available from Spraying Systems Co. of Wheaton, Ill. A continuous spray system does not require a control mechanism and uses a simpler and less expensive nozzle head. Continuous extrusion can be accomplished by any apparatus sufficient to continuously extrude hot pour products at a suitable rate, including for example, the slot die coating module manufactured by Kraemer Koating, Lakewood, N.J.

Pulsed, metered spraying or extrusion may use less hot pour product than continuous spraying or continuous extrusion. Hot pour products often are expensive. Spraying or extruding hot pour products onto material which would not be viewable in the completed hot pour product sampler is often not desirable. In light of this, the use of pulsed, metered spraying or extrusion can be cost effective. In other instances, continuous spraying or continuous extrusion may be more desirous. Continuous spraying or extrusion allows for easier creation of an even laydown of hot pour products. Additionally, continuous spraying may allow for faster press speeds and better quality control. Pulsed, metered spraying or extrusion can help to segregate the hot pour product from any adhesive used to close the base substrate to a cover. If hot pour products mix with an adhesive, the adhesive may lose its adhesion qualities and prevent the unit from remaining closed in areas of contact before use of the invention by an end user. Finally, if hot pour products mix with an adhesive, the adhesive printing plate, as described more fully hereafter, may carry an amount of hot pour products into the adhesive pan. This may cause the bulk adhesive to lose effectiveness. Pulsed, metered spraying or pulsed, metered extrusion can aid in separation of the adhesion and hot pour product.

Hot pour cosmetic should generally be applied in a layer between 0.75 mil and 7 mil in thickness, more preferably between 1 mil and 3 mils and most preferably between 1.25 and 1.50 mils. For lipstick, a layer between approximately one mil and ten mils may be used, and most preferably between 5 and 6 mils.

The shape of the hot pour product layer may be approximately of a square, rectangle, oval or other desired shape. The area of the hot pour product should be sufficient for rubbing off with a human finger, brush, sponge applicator or similarly functioning device and applied to the skin in sufficient quantities as to be evaluated by a customer.

Referring to FIGS. 10–27, there are illustrated various possible embodiments of the individual hot pour product sampler of the present invention.

All embodiments may be produced with a carrier liner or similar pressure sensitive adhesive backing attached to the base. An intermediate sheet may contain die-cut openings to correspond to the area of hot pour product on the base. The die-cut openings may be in any suitable configuration to allow a person to lift the cover and reveal the hot pour product. The intermediate sheet is placed over adhesive onto the base. A top sheet is subsequently adhered on top of the intermediate sheet.

Figure 10:
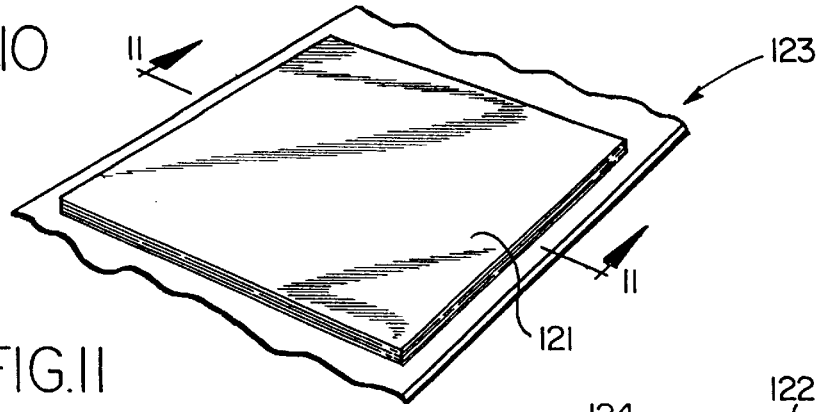
FIG. 10 is a perspective view of the sampler from the preferred embodiment.
Figure 11:
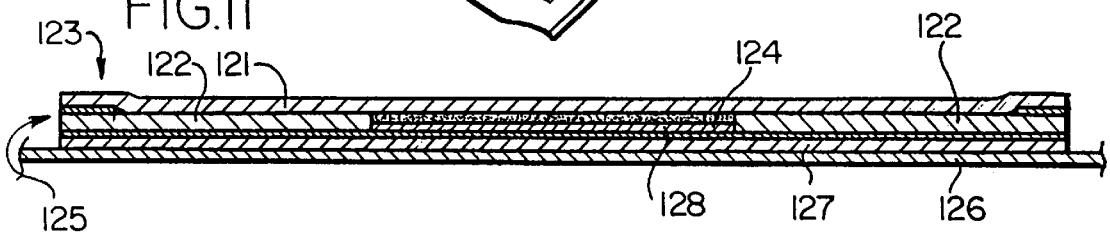
FIG. 11 is a cross-sectional view of the sampler of FIG. 10 taken along line 11—11.

Referring to FIGS. 10 and 11, there is illustrated an embodiment of the present invention. In sampler 123, cover 121 is adhered to intermediate layer 122 by heat seal adhesive 201. Intermediate layer 122 has a die-cut opening which is substantially aligned with genuine hot pour product 124. Base 125 consists of liner 126, bottom layer 127, and a portion of polypropylene layer 128 and permanent adhesive 202.

Another embodiment of the foregoing invention illustrated in FIGS. 12–15 involves application of solely top sheet 130. Top sheet 130 is present over the adhesive or heat seal layer 132 of the base layer 134. Perforations 136 are registered in top sheet 130 by any suitable means to correspond to the location of hot pour products 138 which are surrounded by adhesive on the base layer 134. The entire sample is attached to release liner 140.

Another embodiment of the present invention illustrated in FIGS. 16–19 is sampler 140'. Sampler 140' consists of liner layer 142, base layer 144 with hot pour products 146, and top layer 148 which consists of one sheet, folded in half. On one half of top layer 148, a die-cut opening 150 is placed so as to reveal the hot pour product 146 on base layer 144. Adhesive 147 adheres base layer 144 to half of top layer 148. Permanent or peelable adhesive 145 may be used to adhere the two halves of top layer 148 together.

Another embodiment illustrated in FIGS. 20–23 is hot pour product sampler 154, which is formed by folding over a single sheet 152 to form a Z-folded configuration and using liner layer 159. Folding is achieved by plow folding or any other suitable method. Sheet 152 becomes folded into top fold layer 155, middle fold layer 157, and bottom fold layer 158. Die cut opening 153 which corresponds to the location of hot pour product 156 on the bottom fold layer 158 is registered by any suitable method. Sheet 152 is folded or laminated so that the middle fold layer 157 includes die-cut opening 153. The middle fold layer 157 should be attached to adhesive or heat seal 162 on the bottom fold layer 158. Permanent or peelable adhesive heat seal 161 attaches top fold layer 155 to middle fold layer 157.

Figure 24:
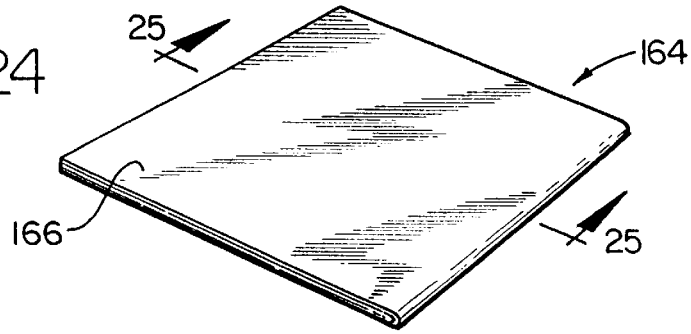
FIG. 24 is a perspective view of a sampler formed on a wide-web offset press.
Figure 25:
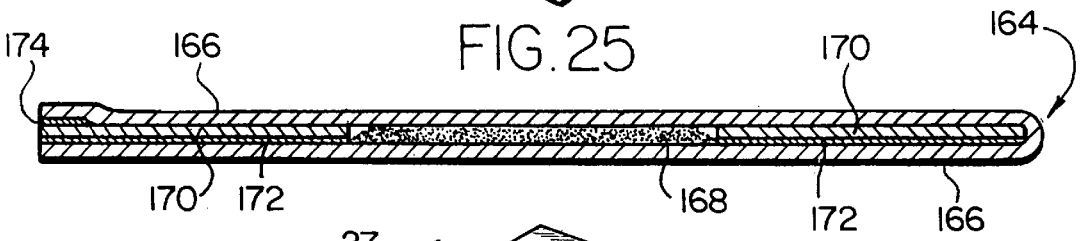
FIG. 25 is a cross-sectional view of the sampler of FIG. 24 taken along line 25—25.

Sampler 164, which may be formed using a wide-web offset press in conjunction with the present invention, is illustrated in FIGS. 24 and 25. Folded layer 166 consists of paper or any other suitable substance. Hot pour product 168 is present on the bottom layer of folded layer 166. Intermediate layer 170 is attached to the area around hot pour product 168 on bottom layer of folded layer 166 by means of adhesive or heat seal 172. Additionally, sampler 164 may be closed using peelable adhesive or peelable heat seal 174.

Figure 26:
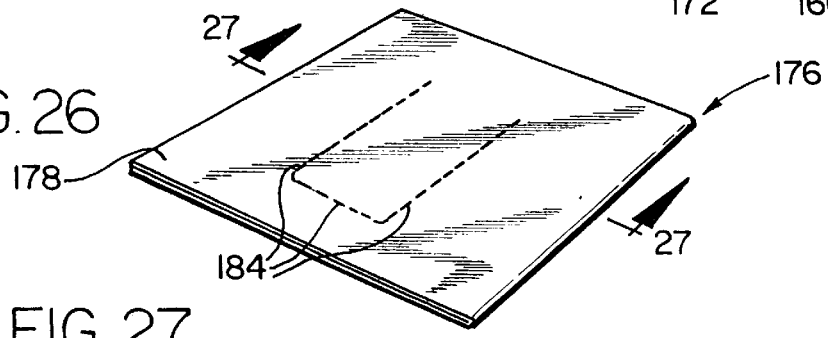
FIG. 26 is a perspective view of an alternative embodiment of a sampler formed using a wide-web offset press.
Figure 27:
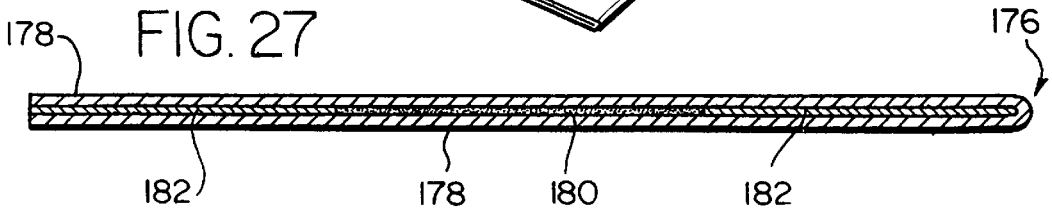
FIG. 27 is a cross-sectional view of the sampler of FIG. 26 taken long line 27—27.
Figure 12:
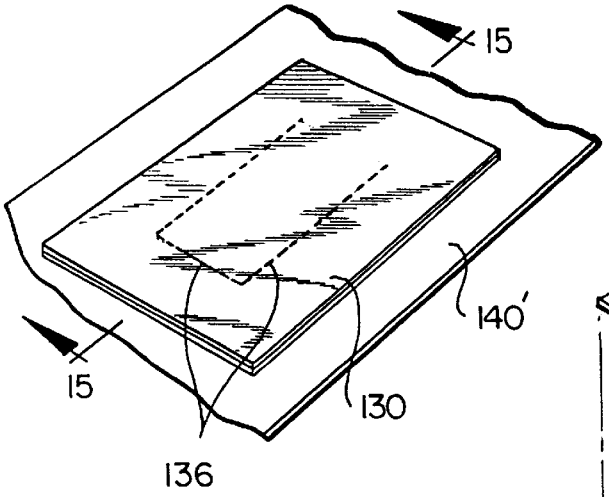
FIG. 12 is a perspective view of a two-layered sampler with the cover layer closed.
Figure 13:
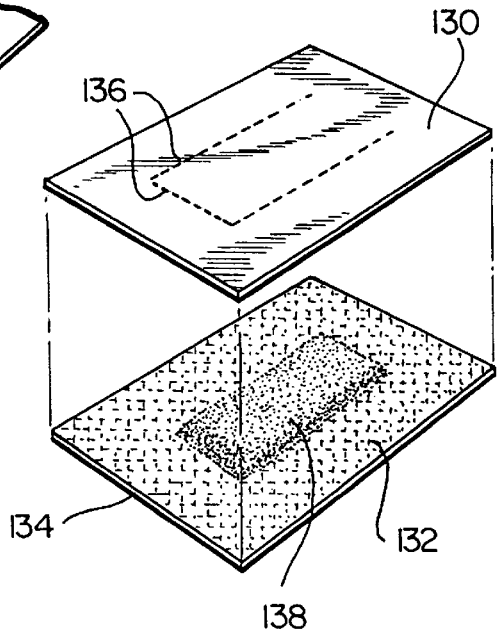
FIG. 13 is a perspective view of the two layers that form the sampler in FIG. 12.
Figure 14:
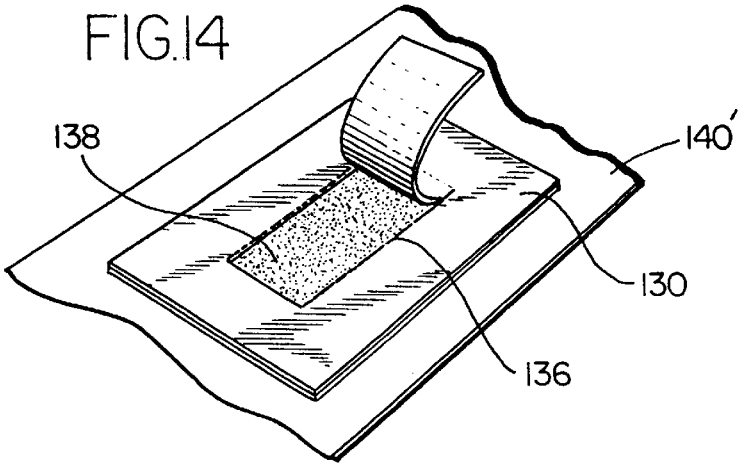
FIG. 14 is a perspective view of the sampler in FIG. 12 showing the cover substrate pulled back exposing the hot pour product.
Figure 15:
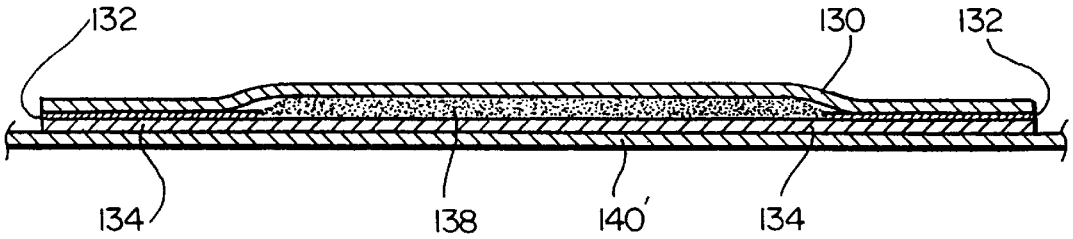
FIG. 15 is a cross-sectional view of the sampler of FIG. 12 taken along line 15—15.
Figure 16:
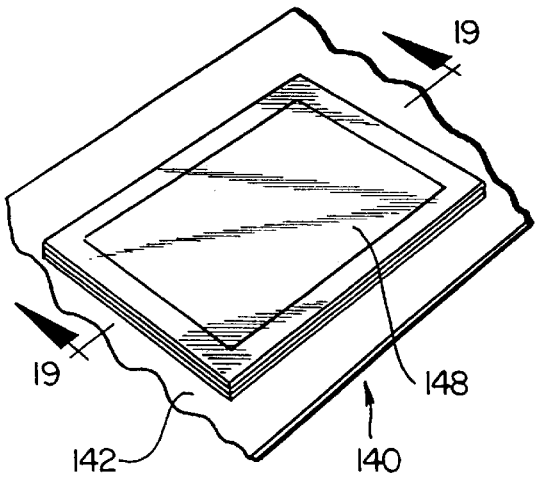
FIG. 16 is a perspective view of a two-layered folded sampler with the cover layer closed.
Figure 17:
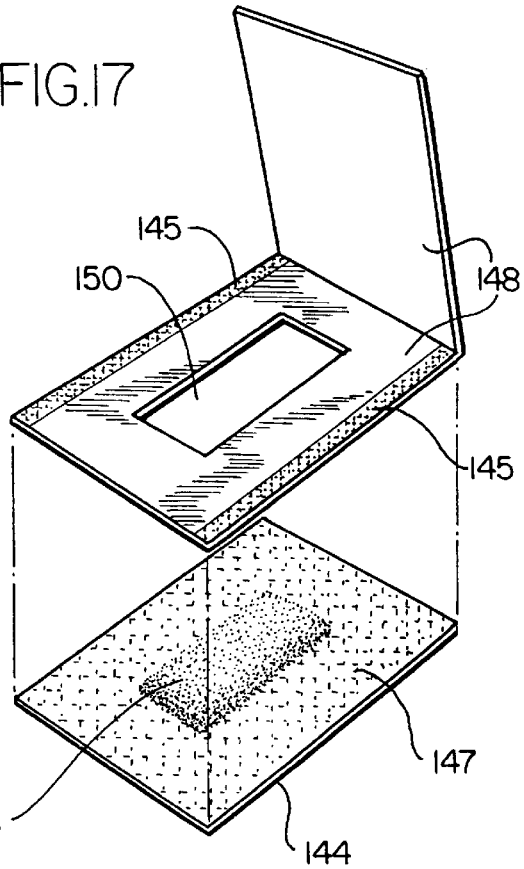
FIG. 17 is a perspective view of the two layers that form the sampler in FIG. 16.
Figure 18:
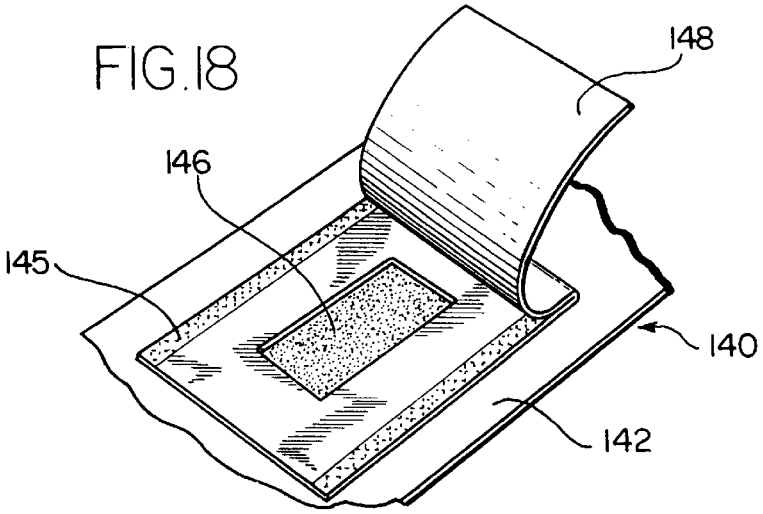
FIG. 18 is a perspective view of the sampler in FIG. 16 showing the cover substrate pulled back exposing the hot pour product.
Figure 19:
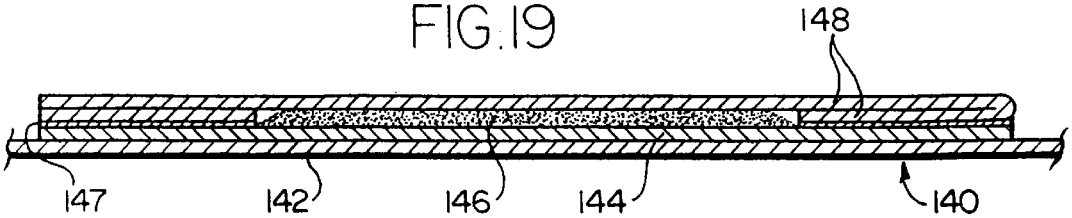
FIG. 19 is a cross-sectional view of the sampler of FIG. 16 taken along line 19—19.
Figure 20:
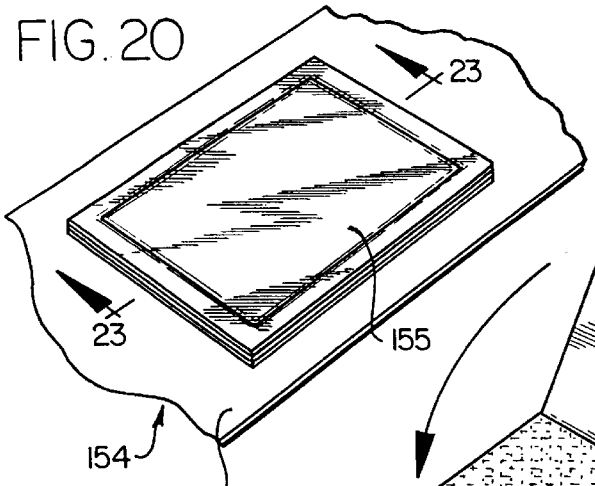
FIG. 20 is a perspective view of a Z-folded sampler with the cover layer closed.
Figure 21:
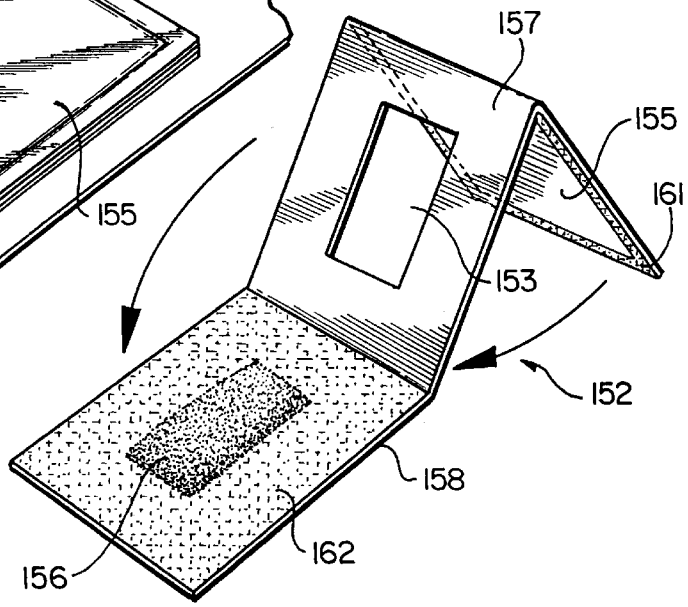
FIG. 21 is a perspective view of the Z-folded substrate that forms the sampler in FIG. 20.
Figure 22:
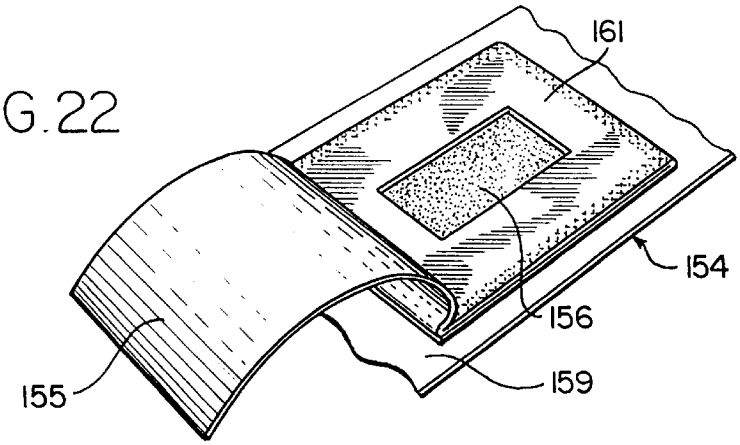
FIG. 22 is a perspective view of the sampler in FIG. 20 showing the cover substrate pulled back exposing the hot pour product.
Figure 23:
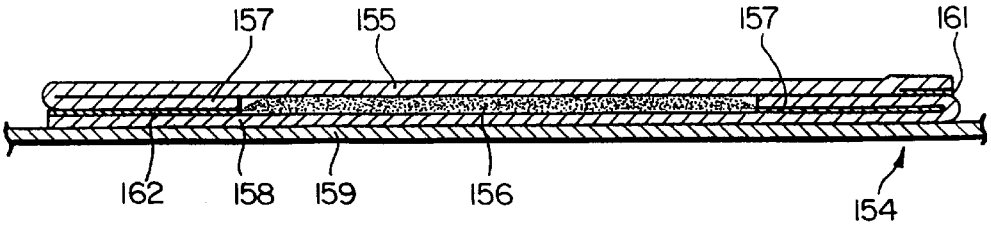
FIG. 23 is a cross-sectional view of the sampler of FIG. 20 taken along line 23—23.

In another embodiment of the present invention, sampler 176 is illustrated in FIGS. 26 and 27. Sampler 176 consists of sheet 178 folded over. Hot pour product 180 is present on the bottom half of sheet 178. Additionally, adhesive or heat seal 182 marries the halves of sheet 178 together. A consumer may peel back perforations 184 on the top of sheet 178 to reveal hot pour product 180.

While the invention has been described with respect to certain preferred embodiments and, as will be appreciated by those skilled in the art, it is to be understood that the invention is capable of numerous changes, modifications and rearrangements and such changes, modifications and rearrangements are intended to be covered by the following claims.

We claim:

1. A method of producing on a base web substrate a hot pour product sampler, which hot pour product is a solid at room temperature incorporating the actual hot pour product to be sampled, comprising:

conveying a base web substrate;

heating the hot pour product to form a substantially liquid flowable hot pour product;

forming a plurality of discrete spaced apart thin film quantities of the heated, substantially flowable hot pour product incorporating the actual hot pour product that is to be sampled on the base web substrate as the base web substrate is being conveyed;

cooling the hot pour product sufficiently to form a substantially solid layer that adheres to the base web substrate while the base web substrate is being conveyed;

adhering a cover sheet web to the base web substrate as the base web is being conveyed, covering the substantially solid hot pour product sample to form a resulting web; and thereafter dividing the resulting web into a plurality of individual hot pour product samplers each comprising a base substrate, the substantially solid quantity of the hot pour product on the base substrate and a cover sheet adhered to the base substrate covering the quantity of hot pour product.

2. The method recited in claim 1 wherein said forming step comprises intermittently spraying a hot pour product to the base web substrate.

3. The method recited in claim 1 wherein said forming step comprises intermittently extruding a hot pour product to the base web substrate.

4. A method of producing a hot pour product sampler which hot pour product is a solid at room temperature incorporating the actual hot pour product to be sampled comprising:

heating the hot pour product to form a substantially liquid flowable hot pour product;

spraying on a base substrate a plurality of discrete spaced apart thin film quantities of the heated, substantially flowable hot pour product incorporating the actual hot pour product that is to be sampled;

cooling the hot pour product sufficiently to form a substantially solid layer that adheres to the base substrate; and adhering a cover sheet substrate to the base substrate, covering the substantially solid hot pour product sample.

5. A method of producing a hot pour product sampler which hot pour product is a solid at room temperature incorporating the actual hot pour product to be sampled comprising:

heating the hot pour product to form a substantially liquid flowable hot pour product;

extruding on a base substrate a plurality of discrete spaced apart thin film quantities of the heated, substantially flowable hot pour product incorporating the actual hot pour product that is to be sampled;

cooling the hot pour product sufficiently to form a substantially solid layer that adheres to the base substrate; and adhering a cover sheet substrate to the base substrate, covering the substantially solid hot pour product sample.

6. A method of producing a hot pour product sampler incorporating the actual hot pour product that is to be sampled comprising the following steps:

conveying a base web substrate;

heating the hot pour product to form a substantially liquid flowable hot pour product;

intermittently applying the heated, substantially flowable hot pour product incorporating the actual hot pour product that is to be sampled to sample areas on the base web substrate covered with the hot pour product to form a plurality of spaced apart quantities of the hot pour product while the base web substrate is being conveyed;

cooling the spaced apart quantities of the hot pour product sufficiently to form a layer of hot pour product that adheres to the base web substrate while the base substrate is being conveyed;

applying an adhesive to a portion of the base substrate not covered by the hot pour product that circumscribes an area of the hot pour product sample while the base web substrate is being conveyed;

attaching a cover sheet web over the base web substrate and covering the heat seal or adhesive and the layer of hot pour product sample to form a resulting web; and dividing the resulting web through areas not having a layer of hot pour product into a plurality of individual hot pour product samplers, each comprising a base substrate, a hot pour product layer and a cover sheet adhered to the base substrate covering the hot pour product layer.

7. The method recited in claim 6 wherein said cover sheet comprises a top sheet and an intermediate sheet, said intermediate sheet being attached to the base web substrate and covering the layer of hot pour product sample.

8. The method recited in claim 7 wherein said intermediate sheet contains a cut-out area exposing the layer of hot pour product sample.

9. The method recited in claim 8 wherein said top sheet and said intermediate sheet are each separate pieces.

10. The method recited in claim 8 wherein said top sheet and intermediate sheet are folded halves of a single piece.

11. The method recited in claim 7 wherein said top sheet, said intermediate sheet and said base web substrate are folded thirds of a single piece.

12. The method recited in claim 6 comprising the further step of registering perforations on the cover sheet of the hot pour product samplers.

13. The method recited in claim 6 wherein said base web substrate is conveyed by means of a web offset press.

14. The method recited in claim 13 wherein said web offset press supplies the base web substrate at a rate of between approximately 300 and 1500 feet per minute.

15. The method recited in claim 6 wherein said base web substrate is conveyed by means of narrow-web roll-to-roll equipment.

16. The method recited in claim 15 wherein said narrow web equipment supplies the base web substrate at a rate of between approximately 30 and 300 feet per minute.

17. The method recited in claim 6 wherein said hot pour product is applied to the base web substrate by spraying.

18. The method recited in claim 6 wherein said hot pour product is applied to the base web substrate by pulsed, metered extrusion.

19. The method recited in claim 6 wherein said layer of hot pour product sample is between approximately 0.001 and 0.010 inches in thickness.

20. An apparatus for producing a hot pour product sampler incorporating the actual hot pour product to be sampled comprising:

means for conveying a base substrate web;

means for heating the hot pour product to form a substantially liquid flowable hot pour product;

an applicator to apply a plurality of discrete spaced apart thin film quantities of the heated, substantially liquid flowable hot pour product that is to be sampled on the base web substrate while the base web substrate is being conveyed;

means for cooling the hot pour product while the base web substrate is being conveyed to form a substantially solid layer that adheres to the base web substrate;

a conveyance system for conveying a cover substrate web and adhering the cover substrate web to the base substrate web;

a cutting system to divide the resulting web into a plurality of individual hot pour product samplers each comprising a base substrate, the solid quantity of the hot pour product on the base substrate and a cover substrate adhered to the base substrate covering the quantity of the hot pour product.

21. The method of claim 2 wherein said spraying step is done using hot pour product having a viscosity within the range of about 25 cps and 600 cps.

22. The method of claim 3 wherein said extrusion step is done using hot pour product having a viscosity within the range of about 300 cps and 1800 cps.

23. The apparatus of claim 20 wherein the applicator comprises a slot nozzle applicator.

24. The apparatus of claim 20 wherein the cooling means comprises a chill roller.

25. The method of claim 5 wherein said extruding step comprises extruding the hot pour product through a slot nozzle.

26. The method of claim 6 wherein said intermittent applying comprises extruding the substantially flowable hot pour product through a slot nozzle that is intermittently opened and closed.

27. The method of claim 26 wherein said intermittent applying further comprises intermittently closing the slot nozzle with a shim.

28. A method of producing a hot pour product sampler containing the actual hot pour product that is to be sampled comprising the following steps:

conveying a base web substrate;

heating the hot pour product that incorporates the actual hot pour product to form a substantially liquefied hot pour product;

intermittently applying the liquefied hot pour product to selected areas on the base web substrate as it is being conveyed, so as to form a plurality of spaced apart quantities of the hot pour product;

cooling the spaced apart quantities of the hot pour product sufficiently to form a layer of the substantially solid hot pour product that adheres to the base web substrate while the base substrate is being conveyed;

cutting perforations into a cover sheet so that said perforations are spaced apart to align with said spaced apart quantities of the substantially solid hot pour product;

affixing the perforated cover sheet to the base web substrate so as to cover the base web substrate and the spaced apart quantities of the substantially solid hot pour product sample and to form a resulting web, wherein the perforations align with the hot pour product; and dividing the resulting web through areas devoid of the substantially solid hot pour product to form a plurality of individual hot pour product samplers, each comprising a base substrate, a hot pour product layer and a cover sheet adhered to the base substrate covering the hot pour product layer.

29. The method of claim 28 wherein said intermittent applying of said hot pour product comprises a process selected from the group consisting of spraying and extruding.

30. The method of claim 28 further comprising, after the cutting step, applying adhesive to the base web substrate on areas around the layers of the substantially solid hot pour product.

31. The method of claim 28 wherein the affixing step comprises applying a heat seal to laminate the base web substrate to the cover sheet.

32. The method of claim 28 wherein said applying step comprises extruding the hot pour product through a slot nozzle.

33. The method of claim 32 wherein the slot nozzle is intermittently opened and closed to cause said intermittent applying.

* * * * *

UNITED STATES PATENT AND TRADEMARK OFFICE

CERTIFICATE OF CORRECTION

PATENT NO. : 6,070,392
DATED : June 6, 2000
INVENTOR(S) : Michael J. Berman et al.

It is certified that error appears in the above-identified patent and that said Letters Patent is hereby corrected as shown below:

Column 3,
Line 38, delete "narrow web" and insert therefor --narrow-web --.
Line 39, delete "roll-to-roll three web" and insert therefor -- roll-to-roll, three-web --.
Line 49, delete "two web" and insert therefor -- two-web --.

Column 8,
Line 14, after "62" insert -- at --.

Column 9,
Line 34, delete "two web" and insert therefor -- two-web --.
Line 42, delete "ultra-violet" and insert therefor -- ultraviolet --.
Line 43, delete "ultra-violet" and insert therefor -- ultraviolet --.

Column 15, claim 10,
Line 37, after "and insert -- said --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*